US011654342B2

(12) United States Patent
Wilson et al.

(10) Patent No.: US 11,654,342 B2
(45) Date of Patent: May 23, 2023

(54) SPRING IMPACT BOXING DUMMY

(71) Applicants: Mark Wilson, Northport, NY (US); Deanna Wilson, Northport, NY (US)

(72) Inventors: Mark Wilson, Northport, NY (US); Deanna Wilson, Northport, NY (US)

( * ) Notice: Subject to any disclaimer, the term of this patent is extended or adjusted under 35 U.S.C. 154(b) by 148 days.

(21) Appl. No.: 17/193,676

(22) Filed: Mar. 5, 2021

(65) Prior Publication Data

US 2022/0280853 A1 Sep. 8, 2022

(51) Int. Cl.

| | |
|---|---|
| ***A63B 69/34*** | (2006.01) |
| ***A63B 69/22*** | (2006.01) |
| *A63B 71/00* | (2006.01) |

(52) U.S. Cl.

CPC ..... *A63B 69/34* (2013.01); *A63B 69/224* (2022.08); *A63B 2071/0063* (2013.01); *A63B 2225/093* (2013.01); *A63B 2244/102* (2013.01)

(58) Field of Classification Search

CPC ..... A63B 69/224; A63B 2071/0063; A63B 2244/102; A63B 2225/093; A63B 69/34

See application file for complete search history.

(56) References Cited

U.S. PATENT DOCUMENTS

| | | | | |
|---|---|---|---|---|
| 3,888,481 | A * | 6/1975 | Adams, Jr. | A63B 69/34 434/247 |
| 4,088,315 | A * | 5/1978 | Schemmel | A63B 69/34 482/84 |
| 5,256,069 | A * | 10/1993 | Snowden, Jr. | A63B 69/34 434/247 |
| 5,665,035 | A * | 9/1997 | Tumminia | A63B 69/004 482/86 |
| 7,828,701 | B1 * | 11/2010 | Chen | A63B 69/34 482/90 |
| 8,647,242 | B2 * | 2/2014 | Schlicher | A63B 21/169 482/84 |
| 9,295,891 | B1 * | 3/2016 | Higgins | A63B 21/0087 |
| 9,498,693 | B1 * | 11/2016 | Kraus | A63B 69/0071 |
| 2004/0005963 | A1 * | 1/2004 | Tudor | A63B 69/34 482/83 |
| 2013/0059699 | A1 * | 3/2013 | Brenner | A63B 69/004 482/83 |
| 2014/0155228 | A1 * | 6/2014 | Salerno | A63B 69/305 482/84 |

* cited by examiner

*Primary Examiner* — Sundhara M Ganesan
*Assistant Examiner* — Jacqueline N L Loberiza
(74) *Attorney, Agent, or Firm* — Lyman Moulton, Esq.; Moulton Patents, PLLC

(57) ABSTRACT

The Spring Impact Boxing Dummy is the only product of its kind that utilizes springs on a target to accurately depict a real life fighting experience to improve strike precision and exactitude. The disclosure is uniquely designed to resemble a human body and face and can be simply mounted onto any wall based on user preferences; therefore, providing users an effective means to train, burn calories in an effort to get in the best shape of their lives. A mount supports springs having a spring force set to a weight of a user of the boxing dummy. A frame is attached to the mount via the springs. The frame includes adjustable tracks for a height adjustment relative to the mount. The boxing dummy includes pads near a head and hands of the boxing dummy and is attached to the frame via the plates.

17 Claims, 2 Drawing Sheets

SPRING IMPACT BOXING DUMMY

BACKGROUND

Boxing and MMA (mixed martial arts) training have become increasingly popular sports among individuals globally. The structure of modern training targets, however, have a great tendency of fracturing individual's joints and are unstable when users try emulating a real fight. The current targets used for this vigorous training frequently move, fall over and wing back and forth thus creating an unrealistic fight experience and leads to an inaccurate aim. There have been no products available as original equipment or as an aftermarket to address this problem.

An apparatus that is stable and resembles more of a life like training scenario, that doesn't have the tendency of fracturing the individual user's joints is absent in the market. There have been no products available as original equipment or as an aftermarket to address this problem either.

There exists a need for an apparatus that is not being met by any known or disclosed device or system of the present market.

SUMMARY OF THE INVENTION

The main purpose of the Spring Impact Boxing Dummy is to provide users with a wall mounted, height adjustable, spring reactive striking boxing and MMA target that provides a more realistic workout experience. A mount supports springs having a spring force set to a weight of a user of the boxing dummy. A frame is attached to the mount via the springs. The frame includes adjustable tracks for a height adjustment relative to the mount. The boxing dummy includes pads near a head and hands of the boxing dummy and is attached to the frame via the plates.

DETAILED DESCRIPTION

Figure 1:
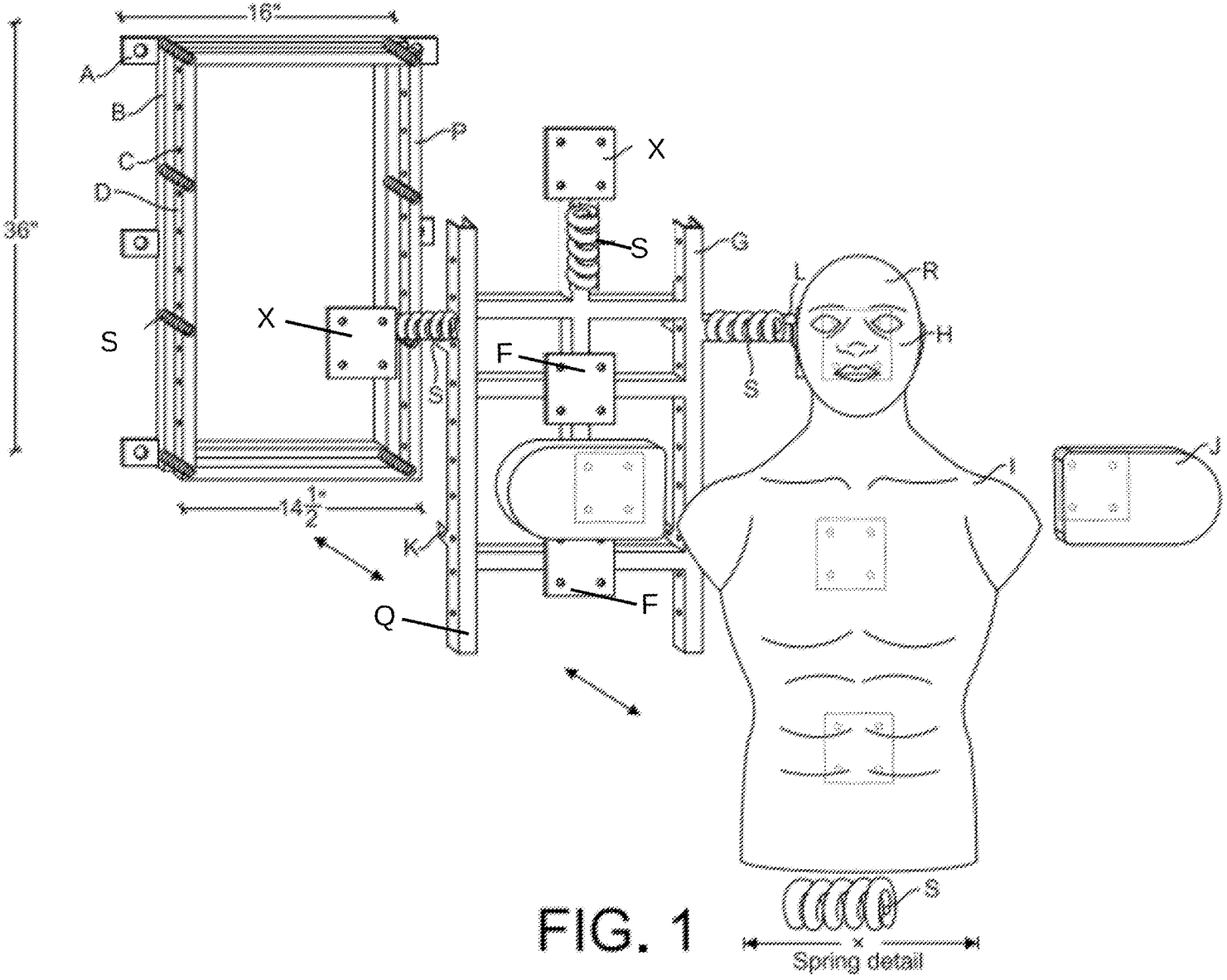
FIG. 1 Is a front perspective view of the Spring Impact Boxing Dummy apparatus in three unassembled parts in accordance with an embodiment of the present disclosure.

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1. Is a front perspective view of the Spring Impact Boxing Dummy apparatus in three unassembled parts in accordance with an embodiment of the present disclosure. The FIG shows A. Anchor points, B. Wall mount, C. 8" groove on both sides to side knob and adjust height, D. Spring frame made of 1" square tube, S. 4" steel springs to put frame Q in tension, Frame plate F and spring plate X. 1½"×1½"×⅛' with ½" holes, G. 1¼" U-shape steel tube, H. head pad, I. Torso pad, J. Hand pad angled 15 degrees downward, and K. 1¼" L-shape steel, The platform P, the mount B, the frame Q and the boxing dummy R are shown disassembled in accordance with an embodiment of the present disclosure. The spring S is shown stretched over a distance x maintaining a spring force of constant tension and constant force for a preset weight.

Figure 2:
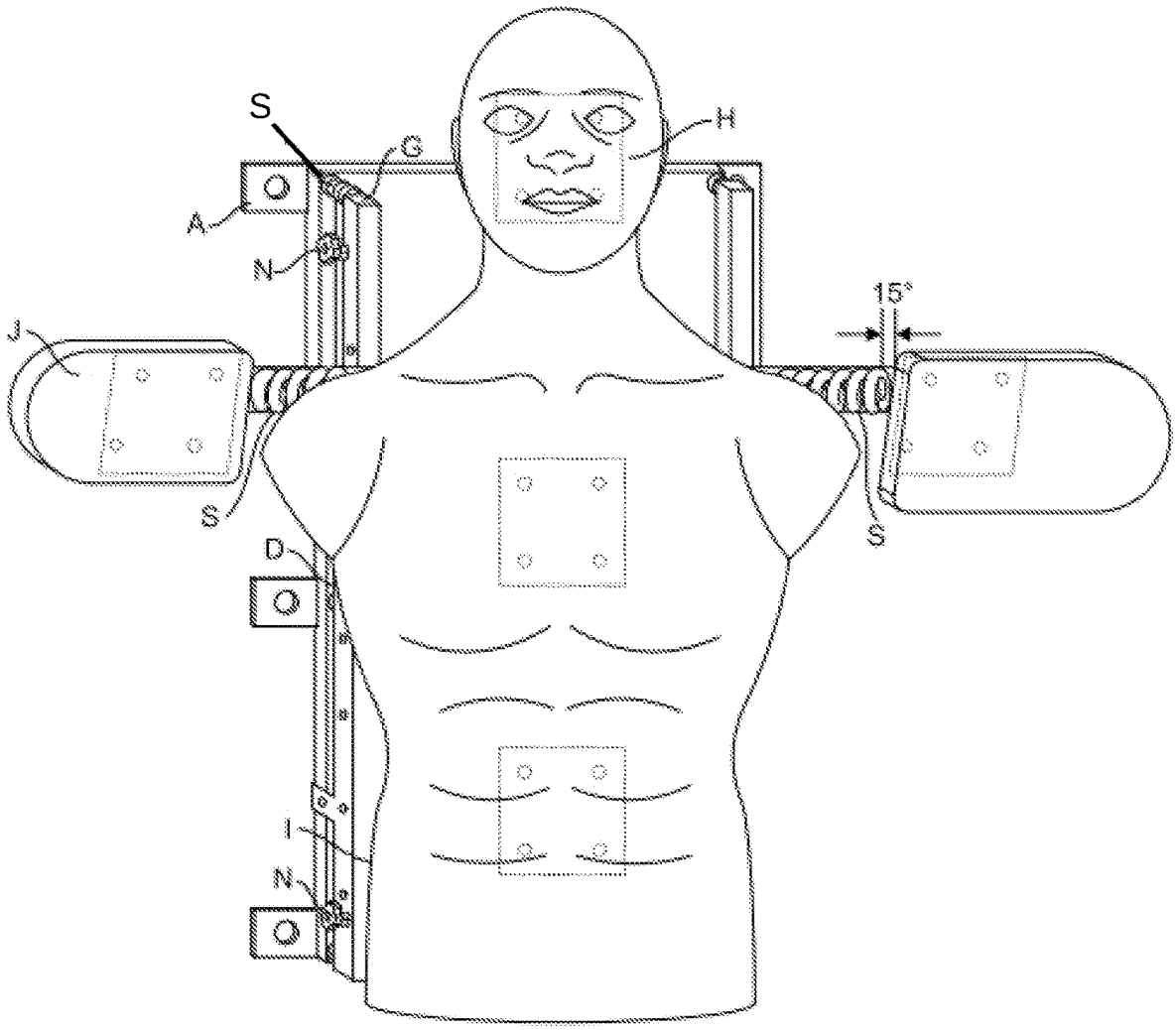
FIG. 2. Is a front perspective view of the assembled Spring Impact Boxing Dummy apparatus in accordance with an embodiment of the present disclosure Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

FIG. 2. Is a front perspective view of the Spring Impact Boxing Dummy apparatus with all of the three parts put together in accordance with an embodiment of the present disclosure. The FIG, shows: H. head pad, I. Torso pad, J. Hand pad, L. Hands are angled 15 degrees downward from a vertical reference. The springs S provide a spring force of constant tension and constant force in accordance with an embodiment of the present disclosure. Locking knobs N attach the platform P on each side thereof to the frame Q and adjust the relative boxing dummy height.

The Spring Impact Boxing Dummy introduces a novel spring technology that creates a more lifelike boxing or MMA experience and therefore facilitates an accurate, intense striking motion for the user. The Spring Impact can be easily mounted on concrete, block, or stud walls and adjusted based on the user's height and reach offering options in height 6" up or down, based on user. A spring force of the spring is set to a weight of a standard user at 200 lbs. recoil force. A spring force of each spring is therefore the standard use weight 200 lbs divided by the number of springs n. The frame of the adjustable height target has body weight tension springs welded within to mimic a real strike motion as these highly flexible springs ensure the target moves in the direction the user is striking, whether a punching or kicking action, while simultaneously absorbing joint stress as the spring compresses and springs back. The Spring Impact primary body target is strategically designed in half round cylinder shape to ensure users are able to perform full body strikes in a variety of angles while adjustment pins on the frame rails will also enable multiple users to train on the same boxing target; thus, ensuring various people are capable of training simultaneously. This innovative, top quality product provides a versatile, authentic, method for boxing and MMA training.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A boxing dummy apparatus comprising:

a mount configured to support a plurality of springs having a spring force preset to a weight;

a frame attached to the mount via the plurality of springs, the frame comprising adjustable tracks for a height adjustment relative to the mount, the frame also comprising a plurality of plates; and a boxing dummy comprising a plurality of pads comprising a head and hands of the boxing dummy and attached to the frame via the plurality of plates.

2. The boxing dummy apparatus of claim 1, wherein the plurality of plates of the frame are proximal the head and the hands of the boxing dummy.

3. The boxing dummy apparatus of claim 1, wherein the plurality of springs of number n each have a spring force equal to the preset weight divided by n.

4. The boxing dummy apparatus of claim 1, wherein the adjustable tracks for the height adjustment of the frame relative to the mount further comprises locking knobs on each track.

5. The boxing dummy apparatus of claim 1, wherein the mount further includes anchor points for fastening to a wall.

6. The boxing dummy apparatus of claim 1, wherein the hands of the boxing dummy are angled downward at 15 degrees from a horizontal level.

7. The boxing dummy apparatus of claim 1, wherein each of the plurality of springs is configured to extend a distance x from an equilibrium position at rest.

8. The boxing dummy apparatus of claim 1, wherein the head comprises a face and the hands comprise the plurality of pads.

9. The boxing dummy apparatus of claim 1, further comprising a torso adjoining the head and the hands.

10. The boxing dummy apparatus of claim 1, wherein the mount further comprises a platform for the frame and attached to a second end of each of the plurality of springs where the first end of each of the plurality of springs is attached to the mount.

11. The boxing dummy apparatus of claim 1, further comprising a spring from the plurality of springs configured to attach a plate of the plurality of plates comprising the hands of the boxing dummy to the frame.

12. The boxing dummy apparatus of claim 1, further comprising a spring from the plurality of springs configured to attach a plate of the plurality of plates comprising the head of the boxing dummy to the frame.

13. The boxing dummy apparatus of claim 1, wherein the frame comprises welded square tubing.

14. The boxing dummy apparatus of claim 1, wherein the frame adjusts relative to the mount in a height direction via a plurality of cotter pins.

15. The boxing dummy system comprising:

a plurality of springs of number n each having a spring force equal to a preset weight divided by the number of springs n;

a mount configured to support a platform via the plurality of springs wherein the platform comprises grooves on each of a lateral side thereof;

a frame attached to the platform via a plurality of locking knobs, the frame also comprising a plurality of attachment points; and a boxing dummy comprising a plurality of pads comprising a head and hands of the boxing dummy and attached to the frame via the plurality of attachment points.

16. The boxing dummy system of claim 15, wherein a height of the boxing dummy is adjusted via the grooves on the platform and the frame.

17. The boxing dummy system of claim 15, further comprising a spring from the plurality of springs configured to attach a plate of a plurality of plates of each hand of the boxing dummy.

* * * * *